United States Patent [19]

Lucas

[11] Patent Number: 5,051,066

[45] Date of Patent: Sep. 24, 1991

[54] GAS COMPRESSION BY PULSE AMPLIFICATION

[76] Inventor: Timothy S. Lucas, 4614 River Hill Ct., Glen Allen, Va. 23060

[21] Appl. No.: 516,708

[22] Filed: Apr. 30, 1990

Related U.S. Application Data

[63] Continuation of Ser. No. 342,977, Sep. 25, 1989, abandoned.

[51] Int. Cl.[5] ..... F04F 11/00

[52] U.S. Cl. ..... 417/207; 417/53; 62/498

[58] Field of Search ..... 417/207, 48, 53; 62/498

[56] References Cited

U.S. PATENT DOCUMENTS 3,272,598 9/1966 Hansel ..... 417/207

FOREIGN PATENT DOCUMENTS 0125202 11/1984 European Pat. Off. ..... 417/207

1244375 7/1986 U.S.S.R. ..... 417/53

*Primary Examiner*—Leonard E. Smith

*Assistant Examiner*—David W. Scheuermann

*Attorney, Agent, or Firm*—Staas & Halsey

[57] ABSTRACT

A compressor which sweeps a localized region of electromagnetic or ultrasonic energy through a gas at the speed of sound, in order to create and maintain a high pressure acoustic pulse in the gas. The compressions and rarefactions associated with this pulse comprise a pressure cycle, by which a low pressure gas is drawn into a pulse chamber, compressed therein, and then discharged as a high pressure gas. By choosing a sweep velocity equal to the speed of sound in the gas, three independent physical effects are synergistically coupled together. This effect-coupling induces a natural pressure amplification, whereby the pulse's pressure exceeds the sum of the pressures which would result from the individual effects. Operation of the compressor requires no moving parts, other than valves, to come in contact with the gas being compressed and conveyed. Therefore, no oil comes in contact with the gas. This compressor is particularly well suited for refrigeration applications, and provides an efficient oil-less refrigeration compressor.

12 Claims, 5 Drawing Sheets

GAS COMPRESSION BY PULSE AMPLIFICATION

This is a continuation of copending application Ser. No. 07/342,977 filed on 4/25/89, now abandoned.

BACKGROUND

1. Field of Invention

This invention relates to apparatus for compressing and conveying gases, and with regard to certain more specific features, to apparatus which are used as compressors in refrigeration and air-conditioning equipment.

2. Description of Prior Art

Since the introduction of vapor-compression technology, a need has existed for more efficient compressors. This need has never been more apparent than today. Due to production cut backs of CFC refrigerants which damage the ozone layer, there will be an increasing reliance on "safer" but less efficient refrigerants. These refrigerants which have lower coefficients of performance, will make it difficult for current compressor technology to keep pace with the increasing efficiency demands of energy conservation. Consequently, there is a need for more efficient refrigeration compressors to offset the resulting increase in national energy consumption.

Heretofore, refrigeration and air-conditioning compressors, which were used in vapor-compression type refrigeration equipment, required many moving parts. Reciprocating, rotary, and centrifugal compressors, which are now commonly used for refrigeration applications, all have numerous moving parts. Each of these compressors will consume a portion of energy which serves only to move its parts against their frictional forces, as well as to overcome their inertia. This energy is lost in overcoming the mechanical friction and inertia of the parts, and cannot contribute to the actual work of gas compression. Therefore, the compressor's efficiency suffers. Moving parts also reduce dependability and increase the cost of operation, since they are subject to mechanical failure and fatigue. Consequently, both the failure rate and the energy consumption of a compressor tend to increase as the number of moving parts increases.

Typical refrigeration and air-conditioning compressors must use oils to reduce the friction and wear of moving parts. The presence of oils in contemporary compressors presents certain difficulties. Compressors which need oil for their operation will allow this oil to mix with the refrigerant. The circulation of this oil through the refrigeration cycle will lower the system's overall coefficient of performance, thus increasing the system's energy consumption. Another disadvantage of oil-refrigerant mixtures relates to the development of new refrigerants. It is hoped that non-ozone depleting refrigerants will be developed to replace the CFC family of refrigerants. For a new refrigerant to be considered successful, it must be compatible with compressor oils. Oil compatibility is the subject of performance and toxicity tests which could add long delays to the release of new refrigerants. Hence, the presence of oils in refrigeration and air-conditioning compressors, reduces system efficiency and slows the development of new refrigerants.

For pumps in general, much effort has been exerted to achieve designs which lack these traditional moving parts and their associated disadvantages. Some of these efforts have produced pumps which seek to operate directly on the pumped medium, using non-mechanical means. Typically these pumps operate by pressurizing the pumped medium using heat. The patent literature contains many examples of these methods. One such example is shown in U.S. Pat. No. 3,898,017 to Mandroian, Aug. 5, 1975. Therein is disclosed a chamber in which a gas is heated and subsequently expelled through an egress means. As the chamber's remaining gas cools the resulting pressure differential causes more gas to be drawn into the chamber through an ingress means. This same method is employed in U.S. Pat. No. 3,397,648 to Henderson, Aug. 20, 1968.

This method of pumping as described in the above patents may work for low pressure differentials, low volume, and slow pumping cycles. However, these pumps would clearly be inadequate were they to be employed as refrigeration compressors. This inadequacy can be seen by examining the ideal gas equation, $PV=nRT$. This equation shows that if a constant volume of gas is to be pressurized by heat alone, then to increase the pressure by a factor of "m", you must increase the temperature by a factor of "m." Thus, to obtain the pressure differentials needed in vapor-compression equipment, the refrigerant would have to be heated to extremely high temperatures. For example, a typical an R-12 refrigeration cycle with a 20° F. evaporator, needs approximately a 3.7 factor gain in pressure from evaporator to condenser. Assuming a superheated vapor of 70° F. arrives at the compressor, to increase the pressure by a factor of 3.7 would require heating the refrigerant to a temperature in excess of 1500° F. Such high temperatures could ionize or possibly disassociate the refrigerant.

Seldom have any of the above mentioned pumping methods been applied to the field of refrigeration. One such attempt is seen in U.S. Pat. No. 2,050,391 to Spencer, Aug. 11, 1936. In the Spencer patent, a chamber is provided in which a gas is heated by spark discharge and subsequently expelled through an egress means, due to the resulting pressure increase. As the chamber's remaining gas cools, the resulting pressure differential causes more gas to be drawn into the chamber through an ingress means. This approach results in ionization of the refrigerant, and could cause highly undesirable chemical reactions within the refrigeration equipment. For a practical refrigeration system, such chemical reactions would be quite unsatisfactory.

It is apparent that oil-free refrigeration and air-conditioning compressors, which require few moving parts, have not been satisfactorily developed. It is also apparent that if such compressors were available, they could simplify the development of new refrigerants, and offer improved dependability and efficiency, thereby reducing energy consumption.

OBJECTS AND ADVANTAGES

Accordingly, several objects and advantages of the invention are:

to provide a means for harnessing the electromagnetic absorption of gases for the purpose of exciting a naturally occurring pressure amplification, thereby optimizing the conversion of electromagnetic energy into a pressure gain of a given gas, and by so doing, obtaining a gas pressurization much higher than the absorption of electromagnetic energy alone could produce, to provide a means for harnessing the ultrasonic absorption of gases for the purpose of exciting a naturally occurring pressure amplification, thereby optimizing the conversion of ultrasonic energy into a pressure gain of a given gas, and by so doing, obtaining a gas pressurization much higher than the absorption of ultrasonic energy along could produce, to provide a highly reliable gas compressor which has no moving parts that come in contact with the gas, other than valves, to provide an efficient oil-less gas compressor which can be driven by any wavelength of electromagnetic or ultrasonic energy which is readily absorbed by the gas, and to provide an electromagnetically or ultrasonically driven gas compressor which can produce pressure cycles fast enough, and can develope pressure differentials large enough, for refrigeration applications.

Further objects and advantages of the invention will become apparent from a consideration of the drawings and ensuing description of it.

LIST OF REFERENCE NUMERALS

Figure 1:
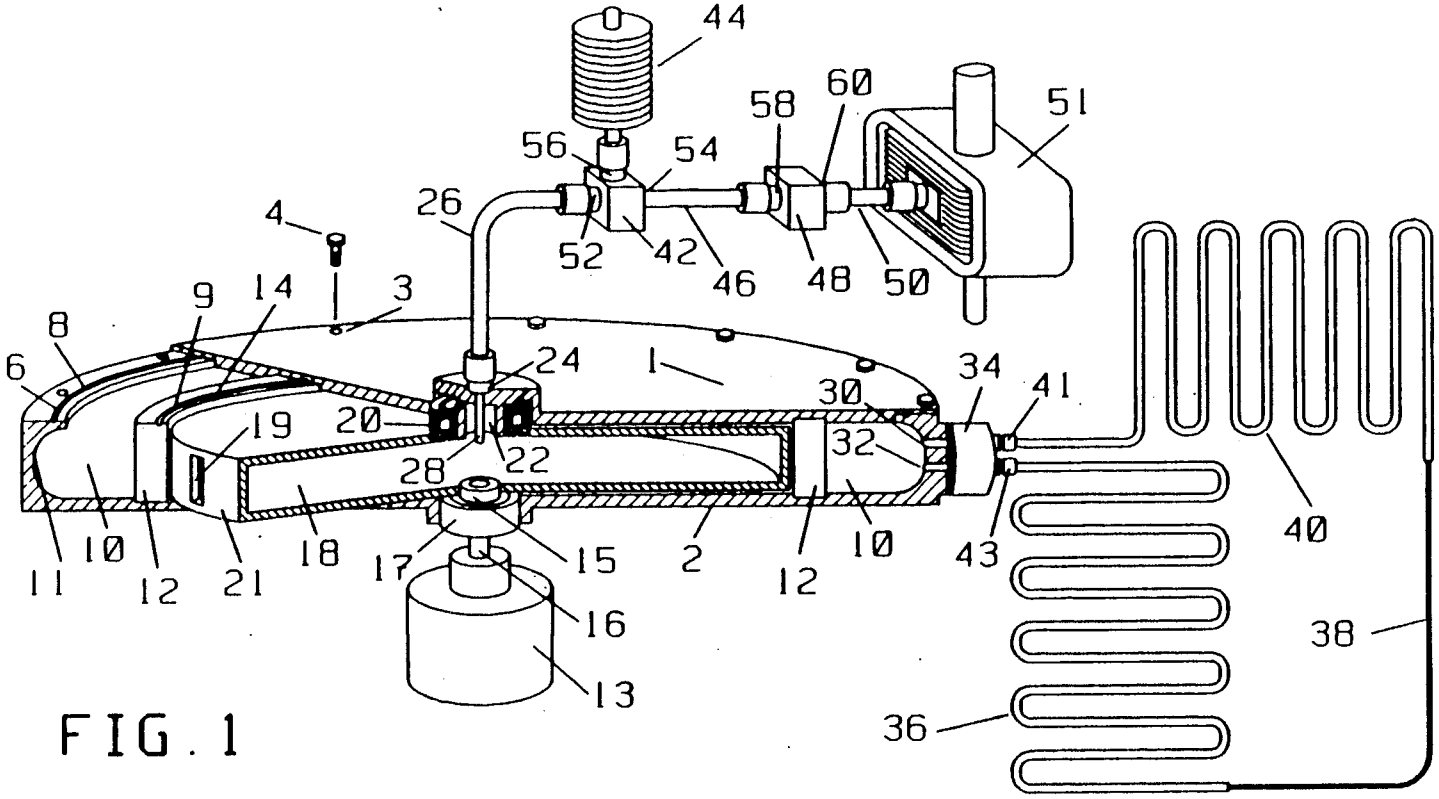
FIG. 1 is a sectional perspective view of the first embodiment of the invention, which uses a spinning microwave resonant chamber as a means of sweeping electromagnetic energy through a gas.

1. top plate
2. chamber body
3. bolt holes
4. bolts
6. o-ring
8. o-ring groove
9. o-ring groove
10. pulse chamber
11. outer wall of chamber body 2
12. microwave window
13. electric motor
14. o-ring
15. inner member of bearing assembly 17
16. motor shaft
17. bearing assembly
18. microwave resonant chamber
19. orifice
20. second bearing assembly
21. outer wall of resonant chamber 18
22. cylindrical cavity
24. coaxial cable connector
26. coaxial cable
28. center conductor
30. suction tube
32. discharge tube
34. reed valve assembly
36. condenser
38. capillary tube
40. evaporator
41. tubing connector
42. microwave circulator
43. tubing connector
44. coaxial terminator
46. coaxial cable
48. isolator
50. coaxial cable
51. magnetron tube
52. circulator port
54. circulator port
56. circulator port
58. isolator port
60. isolator port
62. disk
64. outer wall of disk 62
66. IRLED array
68. pulse chamber
70. electrical terminals
72. wires
73. sliding brushes
74. infrared reflective coating
76. uncoated strip
78. opening in top plate 1
80. chamber cavity
82. feed horn
84. waveguide circulator
86. magnetron tube
88. waveguide terminator
90. waveguide circulator port
92. waveguide circulator port
94. waveguide circulator port
96. reflector
98. pulse chamber
100. identical microwave cavities
100*a*. microwave cavity
100*b*. microwave cavity
100*c*. microwave cavity
100*p*. microwave cavity
102. identical microwave windows
104. coaxial tables
105. coaxial splitter
106. bandpass filters
106*a*. bandpass filter
106*b*. bandpass filter
106*c*. bandpass filter
106*p*. bandpass filter
108. coaxial circulator
110. microwave source 112. coaxial terminator
114. identical microwave radiators
116. coaxial cable
118. multiplexer
120. fixed frequency microwave source
126. acoustic driver
132. pulse chamber
134. microwave cavity
136. pulse injection tube
138. end flange of pulse injection tube 136
140. microwave window
141. pulse chamber
142. identical ultrasonic transducers
144. multiplexer
146. coaxial cables
148. ultrasonic generator
150. coaxial cable
152. spiraling pulse chamber
154. discharge end of spiraling pulse chamber 152
156. suction end of spiraling pulse chamber 152
158. suction end of spiraling partition 162
160. discharge end of spiraling partition 162
162. flat spiraling pulse chamber partition

THEORY OF THE ELECTROMAGNETIC ABSORPTION OF GASES

Many of the embodiments of the present invention owe their successful operation to the ability of certain gas molecules to directly absorb electromagnetic (hereinafter called E&M) energy. In many of the ensuing embodiments, E&M energy is absorbed by the gas, which in turn causes the pressure of the gas to increase. It is the nature of this absorption, and consequent pressure gain, which is crucial to the proper operation of the invention. Therefore, a brief description of the theory of E&M absorption of gases will facilitate a thorough understanding of the ensuing specification.

Different mechanisms exist by which gas molecules can absorb E&M energy. These mechanisms fall roughly into three frequency ranges: optical, infrared, and microwave. At optical frequencies, the molecular transitions due to absorption are primarily electronic. At infrared frequencies, the molecular transitions due to absorption are primarily vibrational. At microwave frequencies, the molecular transitions due to absorption are primarily rotational. If a gas molecule absorbs E&M energy in any of these frequency ranges, it will have a unique absorption spectrum in that frequency range. Due to the quantum nature of events on an atomic scale, this spectrum consists of discrete frequencies at which the individual molecules will absorb E&M energy. These discrete frequencies correspond to the energy level transitions of the molecular species in question.

Both infrared and microwave frequencies of E&M energy, can be used for the pressurization of various gases. However, the relative low cost, efficiency, and high power of microwave electron tubes, makes these sources more practical in many applications. For this reason the embodiments of the present invention place an emphasis on microwave methods. The absorption of infrared energy will be greater in general than the absorption of microwave energy. Therefore, as low cost, efficient, high power infrared sources are developed, they will become the preferable sources for present invention.

Two mechanisms by which microwave absorption can occur in gases are rotational transitions and hindered motion. Rotational transitions are the most prevalent means by which gaseous molecules absorb microwave energy. These rotational transitions are due to the interaction of the molecule's electric (in some cases magnetic) dipole moment with the E&M field. A larger dipole moment will cause a larger interaction with the field and thus a larger absorption of microwave energy. When a molecule absorbs microwave energy, its rotational kinetic energy is increased (i.e. it rotates faster). This excess rotational energy is converted into translational kinetic energy, by way of collisions with neighboring gas molecules. The increase in translational kinetic energy is seen as an increase in the pressure and temperature of the gas. These collisions cause the molecule to relax back to a lower rotational state, where it can again absorb microwave energy. In this way, microwave energy can be used to increase the pressure of a gas.

Hindered motion is another absorption mechanism by which certain molecules can absorb microwave energy. This class of absorption can also be exploited to produce a pressure increase in a gas. An example of a molecule exhibiting hindered motion is ammonia. The absorption of a 1.25 centimeter E&M wave by ammonia is associated with the so-called "turning inside out" of this molecule. In a paper by W. D. Hershberger appearing in the September 1946 issue of the RCA Review entitled "Thermal and Acoustic Effects Attending Absorption of Microwaves by Gases," it is stated that this type of absorption "is so intense that a plane 1.25 centimeter wave will loose 50% of its power on traversing a three foot layer of ammonia at atmospheric pressure and room temperature."

Several unique advantages are discovered when the above E&M absorption mechanisms are employed for the pressurization of gases. The first of these advantages is an extremely fast pressure response time of the gas. When the hindered or rotational motions of the molecules are excited by microwaves, the energy of these motions or "states" is converted, via molecular collisions, into an increase in the gas pressure. The elapsed time between microwave molecular absorption and a pressure increase in the gas, will be approximately equal to the time between molecular collisions. For example, the average time between molecular collisions of gaseous ammonia at 1 atmosphere and 60° F., will be on the order of $10^{-11}$ seconds. This means that the elapsed time between the absorption of E&M energy and a pressure increase in the ammonia gas, will be approximately $10^{-11}$ seconds. Experimental evidence of this characteristically rapid pressure response, was demonstrated in the above mentioned paper by Hershberger. In these experiments, high frequency acoustical waves were driven in absorbing gases by means of modulated or pulsed microwave energy.

A further advantage of using the above microwave absorption mechanisms, lies in the fact that refrigerants are among the best absorbers of microwave energy. This is due to the fact that many refrigerants have unexpectedly large molecular di-pole moments. Consequently, they can be efficiently pressurized by microwave energy of a certain frequency. Also of great advantage is the fact that ammonia, which is used in many refrigeration applications, is even a better absorber than the Freons due to its hindered motion. The magnitude of these microwave absorptions makes it possible to efficiently convert E&M energy into a pressure gain of the absorbing gaseous refrigerant.

A still further advantage results from the fact that the microwave absorption of gases increases with the pressure of the gas. This effect is demonstrated in a paper written by B. Bleaney and J. H. N. Loubser, entitled "The Inversion Spectra of $NH_3$, $CH_3Cl$, and $CH_3Br$ at High Pressures" Proceedings of the Physical Society (London), 63A, 483 (1950). Contributing to these larger absorptions are the increased number of absorbers (i.e. molecules) per unit volume, and the additive overlap of the molecular absorption spectral lines due to pressure broadening effects. Pressure broadening is an effect which causes the frequency width of an absorption spectral line to become wider as pressure increases, thus permitting absorption to occur at frequencies off of an absoption peak. As pressure is increased, adjacent spectral lines will begin to overlap, until eventually the absorption spectrum becomes continuous rather than a series of sharp individual peaks. Also, the quantity of E&M energy absorbed by a gas in a given time, can be limited by an effect called power saturation. Power saturation occurs when the rate at which a gas is absorbing E&M energy is greater than the relaxation rate due to molecular collisions. The collision rate for a single molecule at 1 atmosphere is approximately $10^{11}$ collisions per second. At higher pressures of many atmospheres, the collision rate and therefore the relaxation rate will be much larger. Consequently, large amounts of microwave energy can be absorbed by high pressure gases within the limitations of power saturation. The full advantage of this proportionality between absorption and pressure, will be further realized in the ensuing specification.

Finally, there exists another advantage from using the above microwave absorption mechanism for the pressurization of gases. By examining the absorption vrs. frequency characteristics of a given gas, it will be found that for a given pressure and frequency range, certain frequencies of E&M energy are absorbed more than others. This property is due to the relative intensities of the molecule's absorption lines, which persist even at higher pressures. Although these absorption lines can shift to lower frequencies as pressure increases, the absorption lines of greatest relative intensity will still provide the most efficient E&M absorption even at high pressures. By utilizing this information found in the absorption spectrum of a gas at a given pressure, the most efficient conversion of E&M energy into a pressure gain can be realized.

DESCRIPTION OF THE INVENTION

The preferred embodiment of the present invention comprises a synergistic combination of several physical principles. By inducing the concurrent action of these principles, a high pressure gain in a gas is obtained. This pressure gain is greater than the sum of the pressure gains due to each individual effect. The following embodiments, illustrate several ways in which this amplifying combination of effects can be achieved in a single apparatus.

FIG. 1 shows a perspective sectional view of the first embodiment of the present invention. The embodiment of FIG. 1 includes a chamber body 2 and a top plate 1, which said chamber body and top plate together form a disk-like chamber. Top plate 1 is provided with identical bolt holes which are located at equidistant points around its perimeter. Top plate 1 is fastened to chamber body 2 by identical bolts 4 which pass through said bolts holes in top plate 1 and are threaded into chamber body 2. O-ring 6, which rests in O-ring groove 8 of chamber body 2, is sandwiched between top plate 1 and chamber body 2, thereby forming a pressure seal. A toroidal pulse chamber 10 is provided inside chamber body 2. The boundaries of pulse chamber 10 are defined by chamber body 2, top plate 1, and microwave window 12. Microwave window 12 is a continuous ring of microwave transparent material, such as PYREX, which is permanently fused to chamber body 2. O-ring 14, which rests in O-ring groove 9 of microwave window 12, is sandwiched between top plate 1 and microwave window 12, thereby forming a pressure seal. Only pulse chamber 10 contains the gas to be compressed, which in this case is a refrigerant.

Microwave resonant chamber 18 is press fitted onto the inner member 15 of bearing assembly 17. Motor shaft 16 is fitted into the inner member 15 of bearing assembly 17, by means of mutual splines in motor shaft 16 and inner bearing member 15. This arrangement allows motor 13 to spin microwave resonant chamber 18 while chamber body 2 remains stationary. Bearing assembly 17 is press fitted into chamber body 2. Microwave resonant chamber 18 is also press fitted onto a second bearing assembly 20. Second bearing assembly 20 is press fitted into top plate 1. A cylindrical cavity 22 is machined into top plate 1 and opens into microwave resonant chamber 18. Coaxial cable connector 24 provides an electrical connection between the shield of coaxial cable 26, top plate 1, and microwave resonant chamber 18. Coaxial cable connector 24 also provides an electrical connection between the center conductor of coaxial cable 26 and center conductor 28 in cavity 22. Center conductor 28 extends axially along cylindrical cavity 22 and protrudes into microwave resonant cavity 18. Microwave resonant cavity 18 is provided with orifice 19 which allows some of the microwave energy in resonant cavity 18 to escape through said orifice. It is preferred that the microwave energy which escapes through orifice 19 form a beam, which is radially directed from microwave resonant cavity 18. To this end, a dielectric lens, or a feed horn arrangement, could be placed in orifice 19 which would act to focus the microwave energy into a beam. The use of dielectric lens for the focusing of microwave energy is common to the art of microwave antenna design.

Reed valve assembly 34 is a typical refrigeration compressor type reed valve assembly. Such reed valves are readily available from manufacturers such as the Hoerbiger Valve Company. Suction tube 30 and discharge tube 32 both open into the outer perimeter of pulse chamber 10, thereby connecting reed valve assembly 34 to the pulse chamber 10. Tube connector 43 connects the discharge outlet of reed valve assembly 34 to condenser 36, and tube connector 41 connects the suction inlet of reed valve assembly 34 to evaporator 40. Reed valve assembly 34 serves simply to allow gas to flow only from the evaporator 40 into suction tube 30, and from discharge tube 32 into condenser 36. Flow in a direction opposite to this is prevented. Evaporator 40 and condenser 36 are joined by capillary tube 38. Thus, a closed loop is provided that allows the refrigerant to flow in turn from pulse chamber 10, through discharge tube 32, through reed valve assembly 34, through condenser 36, through capillary tube 38, through evaporator 40, through reed valve assembly 34, through suction tube 30, and finally back into pulse chamber 10.

Coaxial cable 26 connects port 52 of circulator 42 to coaxial cable connector 24. Coaxial terminator 44 is connected to port 56 of circulator 42. Coaxial cable 46 connects port 54 of circulator 42 to port 58 of isolator 48. Coaxial cable 50 connects port 60 of isolator 48 to magnetron 51. Magnetron 51 is a continuous wave source whose frequency is favorable for absorption by the gaseous refrigerant in pulse chamber 10.

In operation, Magnetron 51 generates microwave energy, said microwave energy passing in turn through coaxial cable 50, through isolator 48, through coaxial cable 46, through circulator 42, through coaxial cable 26, through coaxial connector 24 to center conductor 28, and finally being radiated by center conductor 28 into microwave resonant chamber 18. Microwave resonant chamber 18 then acts as a resonant chamber for the microwave energy which is radiated by center conductor 28. While microwave resonant chamber 18 is energized, it is also driven by electric motor 13 which causes it to rotate about its axis. Said rotation of microwave resonant chamber 18, is enabled by bearing assembly 17 and second bearing assembly 20.

Circulator 42 allows microwave energy to pass from circulator port 54 to circulator port 52. Any microwave energy which is reflected back to circulator 42 along coaxial cable 26 will pass from port 52 of circulator 42 to port 56 of circulator 42, thereby entering coaxial terminator 44 where the reflected microwave energy will be absorbed. Circulator 42, coaxial terminator 44, and isolator 48 also provide an added safety feature. If for any reason a large portion of the microwave energy were reflected back to circulator 42 from coaxial cable 26, then coaxial terminator 44 would absorb the reflected microwave energy, converting it into heat. Any reflected microwave energy which managed to pass from circulator port 52 to circulator port 54 would be attenuated by isolator 48. In this way, magnetron 51 is protected from any reflected microwave energy which could damage it.

Some of the microwave energy inside microwave resonant chamber 18 radiates out of orifice 19, and then passes through microwave window 12 and into pulse chamber 10. By means of the microwave absorption of gases discussed above, most of the microwave energy will be absorbed by the volume of gas in pulse chamber 10 which is immediately adjacent to orifice 19. Since microwave resonant chamber 18 is spinning, the microwave energy which radiates out of orifice 19 is swept through the gas in pulse chamber 10. Any microwave energy which radiates out of orifice 19 and arrives at the outer wall 11 of chamber body 2, will be reflected by the outer wall 11 of chamber body 2. After reflection, the microwave energy again passes through the gas and can be further absorbed. Multiple passes between the outer wall 11 of chamber body 2 and the outer wall 21 of microwave resonant chamber 18 may occur, thus facilitating further absorption. The coupling of microwave energy back into resonant chamber 18 may be kept to a minimum by controlling the size of orifice 19. Various other methods of isolation between resonant chamber 18 and pulse chamber 10 will readily occur to those skilled in the art of microwave engineering.

There will be a tendency for pulse chamber 10 to act as a wave guide, and as such, microwave energy would tend to propagate along its curved cavity. But due to the microwave absorption of the gas, this energy will decrease exponentially as a function of circumferential distance away from the position of orifice 19. Thus, the majority of microwave energy is absorbed by the volume of gas in pulse chamber 10, which is immediately adjacent to the instantaneous position of orifice 19.

When this microwave energy is absorbed by the gas in pulse chamber 10 which is adjacent to orifice 19, an acoustic disturbance is created. This acoustic disturbance propagates as a pressure wave away from the absorbing region, and travels through pulse chamber 10 at the speed of sound in the gas. The rotational frequency of microwave resonant chamber 18 is such that the microwave energy is caused to sweep through the gas in pulse chamber 10 at the speed of sound in the gas. Part of the resulting acoustic disturbance, which is generated within the traveling region of absorption, will propagate along pulse chamber 10 in the direction of the sweeping microwave energy. However, this acoustic disturbance will not be able to escape the moving region of absorption, since this moving region of absorption is traveling at the speed of sound in the gas. Since this pressure wave cannot escape the region of absorption, the pressure of the pulse will continue to increase. In other words, the pressure disturbance which would normally travel out ahead of the absorption region cannot escape the absorption region, since the absorption region is traveling at the speed of sound in the gas. So, by causing the microwave energy to sweep through the gas at the speed of sound in the gas, the pressure of the pulse is dramatically increased.

This same effect can be viewed from a different perspective. Much of the microwave energy which is absorbed by a gas is dissipated in the form of acoustic energy, which propagates away from the region of absorption. By causing the microwave energy to sweep through the gas at the speed of sound in the gas, some of this acoustic energy is trapped in the absorption region. Consequently, the total energy dissipated from the absorption region due to acoustic radiation is reduced.

Two additional effects exist which will further increase the pressure and density of the pulse. These two effects are acoustic nonlinearities, and increased microwave absorption. As more and more energy is added to the pulse, the pulse will begin to show nonlinear behavior. As the pressure of the pulse rises due to the trapping of acoustic energy, its propagation will become increasingly governed by nonlinear effects. Thus, the pulse evolves into a shock wave, which is characterized by a high pressure high density wave front. As explained above, the E&M absorption of gases will increase as the pressure and density of the gas increases. Therefore, as the pressure and density of the pulse increases due to nonlinear effects, the microwave absorption of the pulse is caused to increase. This boost in microwave absorption causes the pulse to absorb even more energy from the microwave field, which in turn makes the pulse increasingly nonlinear, and therefore further increase the microwave absorbtion of the pulse, and so on. By means of this self feeding cycle, the pulse is amplified to a high pressure.

As the pulse travels continuously around the pulse chamber 10, it passes over suction tube 30 and discharge tube 32. The presence of the high pressure pulse at the discharge tube 32, causes the discharge reed in reed valve assembly 34 to open, thereby allowing the compressed gaseous refrigerant to enter the condenser 36. This refrigerant condenses in condenser 36 and passes through capillary tube 38 into evaporator 40. The high pressure pulse in pulse chamber 10 will be followed by a rarefraction. The presence of this rarefaction at suction tube 30, causes the suction reed in reed valve assembly 34 to open, thereby drawing the gaseous refrigerant from evaporator 40 into pulse chamber 10. The suction reed of reed valve assembly 34, will also tend to open when the pressure of the gas between the pulses becomes lower than the pressure in the evaporator, due to the continuous discharge of gas through discharge tube 32. Thus, as the pulse travels continuously around the pulse chamber 10, a typical vapor-compression refrigeration cycle is driven.

The efficiency of this embodiment can be optimized by selecting the proper base pressure (i.e. the gas pressure in the absence of incident E&M energy) inside pulse chamber 10. When used for a refrigeration system, a base pressure within pulse chamber 10 may be chosen which is intermediate to the pressures of the evaporator 40 and condenser 36. For example, consider a base pressure chosen at a point midway between the evaporator pressure and the condenser pressure. In this case the pulse's pressure need only increase from the mid-point to the condenser pressure, and the rarefaction's pressure need only drop from the mid-point to the evaporator pressure. Whereas, if the base pressure were equal to the evaporator pressure, the pulse's pressure must increase all the way from the evaporator pressure to the condenser pressure. Therefore, by picking a base pressure midway between the evaporator and condenser pressures, far less energy need be added to the pulse to achieve the desired pressure differential. The advantage of base pressure selection, applies equally well to all of the ensuing embodiments of the present invention.

Control of the base pressure in pulse chamber 10, can be achieved by placing a shut-off valve between the discharge of reed valve assembly 34 and condenser 36. This valve would provide a temporary pressurization cycle when the unit is first switched on. Such a valve would prevent any gas from leaving pulse chamber 10. During this brief pressurization cycle, the base pressure will rise as new gas is drawn into pulse chamber 10 through suction tube 30, due to the pulse's ongoing rarefactions. Once the desired base pressure is achieved, the shut-off valve could reopen, and normal operation would resume.

The velocity of the pulse in pulse chamber 10 will vary if the pressure and temperature of the gas in pulse chamber 10 varies. For optimal performance, motor 13 should be of a variable speed type, to allow adjustment of the rotational frequency of resonant chamber 18. By varying the rotational frequency of the resonant chamber 18, the tangential velocity of orifice 19 can be made to match the speed of sound in the gaseous refrigerant. An electronic control circuit can be provided which could vary the speed of motor 13 in response to pressure information. For example, a phase-locked-loop or a microprocessor control circuit could read pressure information from a transducer in pulse chamber 10, and make appropriate adjustments in the speed of motor 13. Many other control circuits could be easily designed by one skilled in the art of electronic controls.

It should be mentioned that many pulses can be caused to travel around pulse chamber 10 at the same time. This can be accomplished by simply providing many orifices in microwave resonant chamber 18. Also, the resonant chamber 18 could be replaced by other components which would serve the same function. For example, resonant chamber 18 could be replaced with a spinning wave guide, whose one end would be energized by center conductor 28, and whose other end would radiate microwave energy through a feed horn or dielectric antenna.

Figure 2:
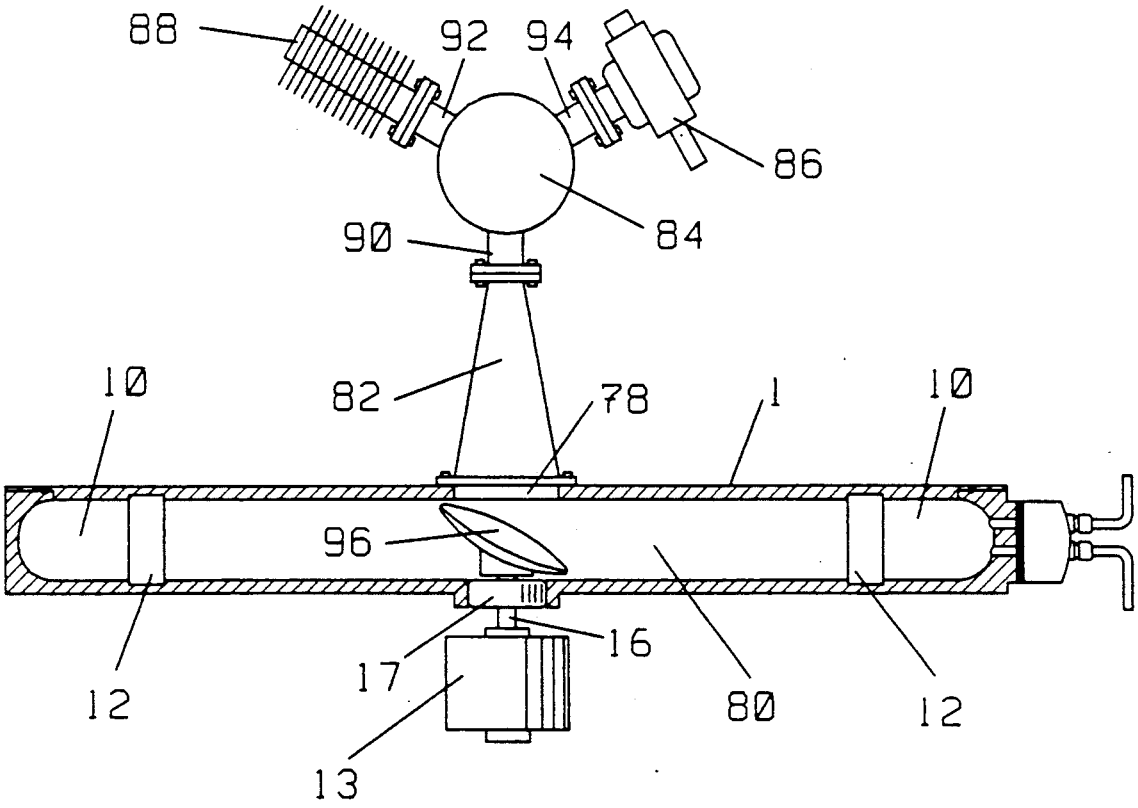
FIG. 2 is a sectional side view of a second embodiment of the invention, which uses a spinning reflector as a means of sweeping electromagnetic energy through a gas.

FIG. 2 shows a sectional side view of a second embodiment which exploits pulse amplification. The embodiment of FIG. 2 is a modified version of the embodiment of FIG. 1; the primary difference being the method by which microwave energy is caused to sweep through the gas in pulse chamber 10. A microwave feed horn 82 is provided which is fastened to top plate 1 by common flange bolts. Top plate 1 has opening 78 through which microwave energy from feed horn 82 can enter into chamber cavity 80. Port 90 of waveguide circulator 84 is fastened to feed horn 82 by common flange bolts. Magnetron tube 86 is fastened to port 94 of waveguide circulator 84 by common flange bolts. Waveguide terminator 88 is fastened to port 92 of waveguide circulator 84 by common flange bolts. Reflector 96 is fastened to motor shaft 16, such that reflector 96 will be spun by motor 13 about the axis of motor shaft 16. The surface curvature of reflector 96 is designed such that any microwave energy which enters chamber cavity 80 through feed horn 82, will be reflected so as to pass through microwave window 12 and into pulse chamber 10. The surface of reflector 96 could be spherical, parabolic, or any shape which provides the proper focusing for a particular application. For additional focusing of the microwave energy, a dielectric lens could be placed in opening 78 of top plate 1. If so desired, motor 13 which spins reflector 96, could be placed inside chamber cavity 80, provided it does not block the reflected microwave energy. This would eliminate the need for bearing assembly 17.

In operation, Magnetron tube 86 generates continuous microwave energy which travels through circulator 84, through feed horn 82, and then into chamber cavity 80 where it is reflected by reflector 96. This reflected microwave energy will pass through microwave window 12 and be absorbed by the gas in pulse chamber 10. Motor 13 causes reflector 96 to rotate about the axis of motor shaft 16. This rotation of reflector 96 causes the reflected microwave energy to sweep around the pulse chamber 10. The speed of motor 13 is such that the reflected microwave energy sweeps through the gas in pulse chamber 10 at the speed of sound in the gas. Resultantly, a high pressure pulse is created which travels around pulse chamber 10. This traveling pulse creates a suction-discharge pressure cycle, in exactly the same manner and according to the same principles, as described in the embodiment of FIG. 1.

The embodiment of FIG. 2 can also be used in conjunction with an infrared source of E&M energy. In this case, feedhorn 82 would be removed to allow E&M energy from an infrared source to pass through opening 78 and be reflected by reflector 96 as it spins about driveshaft 16. Such sources of infrared energy could include gas discharge tubes, filament tubes, LASERs, and solar. Reflector 96 would be redesigned to accommodate infrared wavelengths rather than microwave wavelengths of E&M energy, and microwave window 12 would be transparent to infrared energy. Also, the inner surface of pulse chamber 10 could be coated with an infrared reflective material, to allow for complete absorption by the gas rather than by the chamber walls.

Just as in the embodiment of FIG. 1, the velocity of the pulse in pulse chamber 10 of FIG. 2 will vary if the pressure and temperature of the gas in pulse chamber 10 varies. For optimal performance, motor 13 should be of a variable speed type to allow adjustment of the rotational frequency of reflector 96. By varying the rotational frequency of the reflector 96, the velocity of the microwave absorption region in pulse chamber 10, can be made to match the speed of sound in the gas. An electronic control circuit can be provided which could vary the speed of motor 13 in response to pressure information. For example, a phase-locked-loop or a microprocessor control circuit could read pressure information from a transducer in pulse chamber 10, and make appropriate adjustments in the speed of motor 13. Many other control circuits could be easily designed by one skilled in the art of electronic controls.

Figure 3:
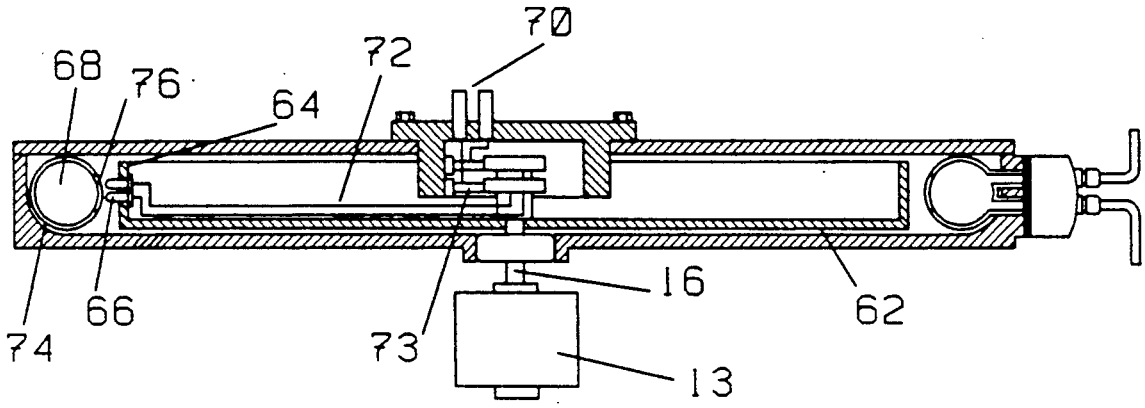
FIG. 3 is a sectional side view of a third embodiment of the invention, which uses a spinning disk, with IRLEDs mounted thereto, as a means of sweeping electromagnetic energy through a gas.

FIG. 3 shows a perspective sectional view of a third embodiment which exploits pulse amplification. The embodiment of FIG. 3 shows a modified version of the embodiment of FIG. 1. In FIG. 3, the microwave resonant chamber 18 of FIG. 1 has been replaced with disk 62. Mounted in outer wall 64 of disk 62 is an array of Infrared Light Emitting Diodes 66 (hereinafter called IRLEDs). Disk 62 is affixed to motor shaft 16 and both are free to rotate about the axis of motor shaft 16. Pulse chamber 10 of FIG. 1 has been replaced with pulse chamber 68 in FIG. 3. Pulse chamber 68 is a hollow tube, being constructed of a material which is transparent to infrared radiation. Except for an uncoated strip 76 around the inner circumference of pulse chamber 68, the entire pulse chamber is covered with an infrared reflective coating 74. Electrical terminals 70 provide an unbroken electrical connection to the IRLEDs by way of sliding electrical brushes 73 and wires 72. Such sliding electrical brushes 73 are common to electrical motors, alternators, and generators. This arrangement serves to supply the IRLEDs with current while disk 62 is rotating.

In operation, current is supplied to IRLEDs 66 by way of electrical terminals 70, sliding brushes 73, and wires 72. The infrared radiation which is emitted from IRLEDs 66, passes through the uncoated strip 76 of pulse chamber 68 and is absorbed by the gas inside pulse chamber 68. Any I.R. radiation which passes unabsorbed through the gas, will be reflected by reflective coating 74 back into the gas and absorbed. Disk 62 is driven by motor 13 at a speed that causes the I.R. energy which is emitted from IRLEDs 66 to sweep through the gas inside pulse chamber 68 at the speed of sound in the gas. Resultantly, a high pressure pulse is created which travels around pulse chamber 68. This traveling pulse creates a suction and discharge pressure cycle, in exactly the same manner and according to the same principles, as described in the embodiment of FIG. 1. Even though infrared radiation is utilized, the principles of acoustic trapping, nonlinearity, and increased absorption will still be active in creating a high pressure pulse.

The embodiment of FIG. 3 offers the advantage of miniaturization. In most cases, the infrared absorption of a gas will be much higher than the microwave absorption. This allows much more E&M energy to be absorbed in a smaller volume of gas. Consequently, a pulse chamber with a smaller cross sectional area can be used. Such a miniaturized version could be used for small refrigeration applications, where Btu requirements are low.

Just as in the embodiment of FIG. 1, the velocity of the pulse in pulse chamber 68 of FIG. 3 will vary if the pressure and temperature of the gas in pulse chamber 68 varies. For optimal performance, motor 13 should be of a variable speed type to allow adjustment of the rotational frequency of disk 62. By varying the rotational frequency of the disk 62, the tangential velocity of IRLEDs 66, can be made to match the speed of sound in the gas. An electronic control circuit can be provided which could vary the speed of motor 13 in response to pressure information. For example, a phase-locked-loop or a microprocessor control circuit could read pressure information from a transducer in pulse chamber 68, and make appropriate adjustments in the speed of motor 13. Many other control circuits could be easily designed by one skilled in the art of electronic controls.

Figure 4:
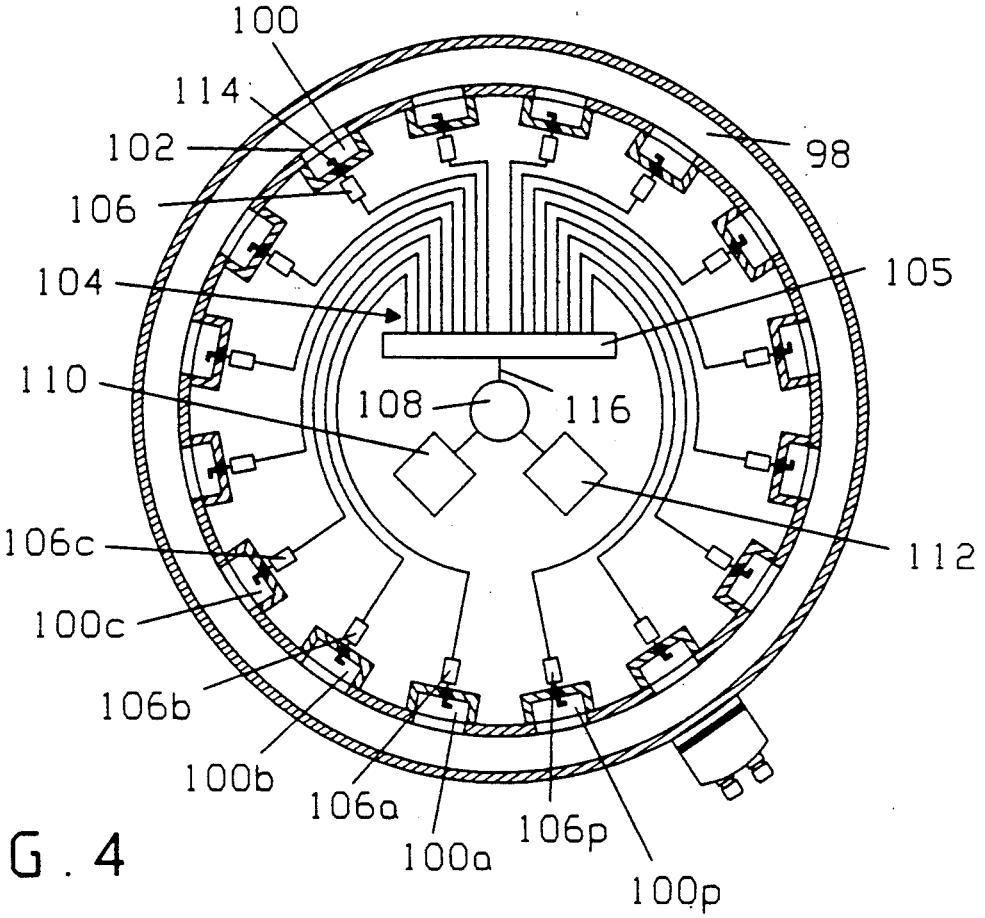
FIG. 4 is a partly sectional partly schematic view of a fourth embodiment of the invention, which uses a system of coaxial bandpass filters and a variable frequency microwave source as a means of sweeping electromagnetic energy through a gas.

FIG. 4 shows a partly schematic partly sectional view of a fourth embodiment which exploits pulse amplification. In FIG. 4 a pulse chamber 98 is provided to which are attached identical microwave cavities 100. Microwave cavities 100 are located at equidistant points along the circumference of pulse chamber 98. Each of the microwave cavities 100 is isolated by identical microwave windows 102, which allow microwave energy to pass from the microwave cavities 100 into pulse chamber 98, but will not allow the gas in pulse chamber 98 to enter microwave cavities 100. Each of the microwave cavities 100 is provided with bandpass filters 106. Going clockwise around pulse tube 98, each of the bandpass filters 106 will have a pass band frequency slightly lower than the next filter. For example, filter **106*a* will have a band pass frequency lower than 106*b*, and filter 106*b* will have a band pass frequency lower than 106*c*, and so on up to filter 106*p*. Each of the band pass filters 106 is connected by a coaxial cable to identical radiators 114 in each single microwave cavity 100. When supplied with microwave energy, each identical radiator 114 will radiate the energy into its own microwave cavity 100. Bandpass filters 106 are all connected to coaxial splitter 105 by coaxial cables 104. Microwave source 110 supplies microwave energy to coaxial splitter 105 through coaxial circulator 108 and coaxial cable 116. Microwave source 110 can be swept over a frequency range which includes all the pass band frequencies of bandpass filters 106. As in the previous embodiments, coaxial terminator 112 absorbs any microwave energy that may be reflected back to coaxial circulator 108**.

In operation, microwave source 110 is caused to sweep over a frequency range which starts at the pass band frequency of bandpass filter **106*a* and ends at the pass band frequency of bandpass filter 106*p*=. This swept microwave energy passes through circulator 108, through coaxial cable 116, and into the input of coaxial splitter 105. Coaxial splitter 105 evenly divides the microwave power into each of the cables 104. As the microwave source 110 sweeps through the frequency range, its frequency begins at the pass band value of filter 106*a*. Filter 106*a* then allows the microwave energy to pass, and microwave cavity 100*a* is energized. As microwave source 110 continues to sweep, its frequency passes out of the range of bandpass filter 106*a*, and into the range of bandpass filter 106*b*. Thus, filter 106*a* blocks the microwave energy so that cavity 100*a* is no longer energized, and filter 106*b* passes the microwave energy causing microwave cavity 100*b* to be energized. As source 110 continues to sweep, its frequency passes out of the range of bandpass filter 106*b*, and into the range of bandpass filter 106*c*. Thus, filter 106*b* blocks the microwave energy so that cavity 100*b* is no longer energized, and filter 106*c* passes the microwave energy causing microwave cavity 100*c*** to be energized.

In this way, as the microwave source sweeps through its frequency range, each of the microwave cavities 100 will be energized in turn.

Identical microwave windows 102 allow the microwave energy in an energized cavity 100 to pass into pulse chamber 98 where it is absorbed by the gas therein. As the microwave cavities are energized in sequence, the microwave energy is caused to circulate around the pulse chamber 98. Bandpass filters 106 have finite band widths, and as such their pass bands will overlap some what with adjacent filters. This overlap of pass bands, allows a time transition of power from cavity to cavity, rather than discrete jumps of power from cavity to cavity. In other words, the power in one microwave cavity declines as the power in the next microwave cavity increases, thereby creating a smooth transition of power from one microwave cavity to the next. Thus, the ideal of a true traveling region of E&M energy around pulse chamber 98 is simulated.

By properly adjusting the sweep rate of microwave source 110, the microwave energy is circulated around the pulse chamber 98 at the speed of sound in the gas. This causes a high pressure traveling pulse to be developed in the pulse chamber 98 in exactly the same manner and according to the same principles as described in the embodiment of FIG. 1. This traveling pulse creates a suction and discharge pressure cycle in exactly the same manner and according to the same principles as described in the embodiment of FIG. 1.

Although the absorption of the gas in pulse chamber 98 will vary somewhat with a change in frequency, the pressure broadening of the gas's absorption lines will permit absorption to continue over a finite frequency range. So for proper operation, the sweep frequency range of microwave source 110 should be kept within the absorption frequency range of the gas.

For ease of illustration, the number of microwave cavities 100 in FIG. 4 is limited. However, more microwave cavities 100 could be added, with the advantage of providing better localization and smoother movement of the microwave power around the pulse chamber 98. The more cavities added, the closer the embodiment of FIG. 4 approaches the ideal of focusing the microwave energy on the pulse at all times.

As in the embodiment of FIG. 1, the velocity of the pulse in pulse chamber 98 will vary if the pressure and temperature of the gas in pulse chamber 98 varies. For optimal performance, the sweep rate of microwave source 110 should be variable, to allow adjustment of the velocity at which the microwave energy moves through pulse chamber 98. By varying the sweep rate of microwave source 110, the velocity of the absorption region within pulse chamber 98, can be made to match the speed of sound in the gas. An electronic control circuit can be provided which could vary the sweep rate of microwave source 110 in response to pressure information. For example, a phase-locked-loop or a microprocessor control circuit could read pressure information from a transducer in pulse chamber 98, and make appropriate adjustments in the sweep rate of microwave source 110. Many other control circuits could be easily designed by one skilled in the art of electronic controls.

Figure 5:
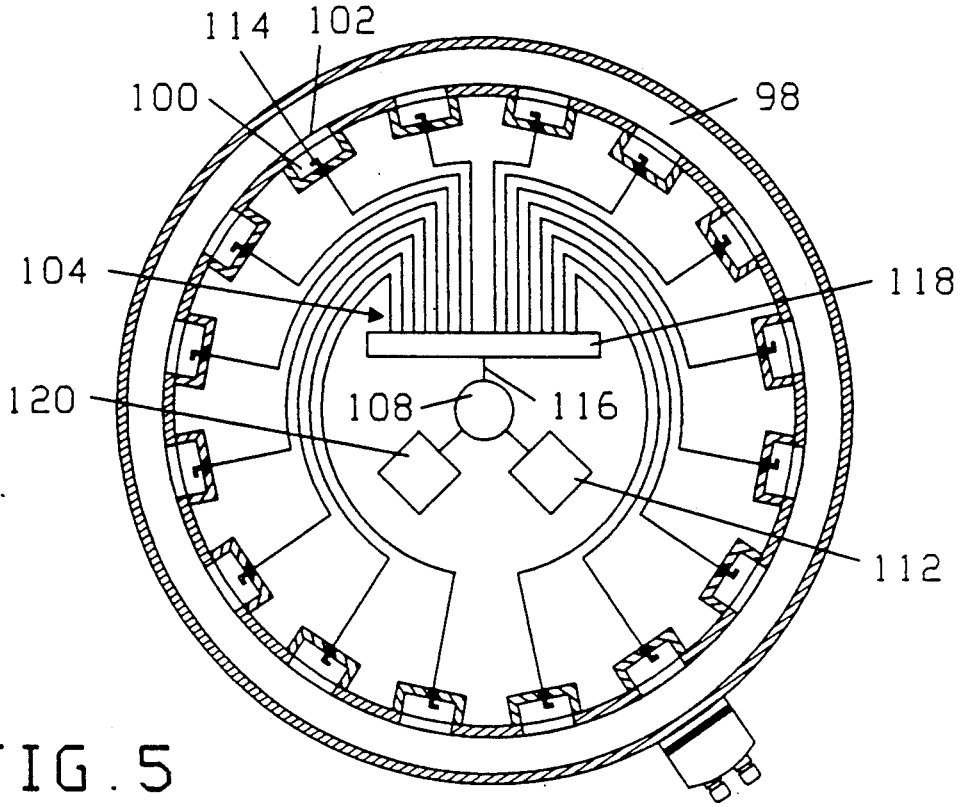
FIG. 5 is a partly sectional partly schematic view of a fifth embodiment of the invention, which uses a coaxial multiplexer as a means of sweeping electromagnetic energy through a gas.

FIG. 5 shows a partly schematic partly sectional view of a fifth embodiment which exploits pulse amplification. The embodiment of FIG. 5 is identical in construction with the embodiment of FIG. 4. Only the electronic components have been altered. The coaxial splitter of FIG. 4 has been replaced with multiplexer 118 in FIG. 5. Variable frequency microwave source 110 of FIG. 4 has been replaced with fixed frequency source 120 in FIG. 5. Bandpass filters 106 of FIG. 5 have been eliminated.

In operation, microwave source 120 produces microwave energy which passes through coaxial circulator 108 and through coaxial cable 116 into multiplexer 118. Multiplexer 118 sequentially connects the coaxial cable 116 to the individual cables 104. In this way, microwave power is applied in sequence to the individual radiators 114 in microwave cavities 100. Thus, the microwave cavities 100 are energized in sequence, one at a time. Microwave windows 102 allow the microwave energy in an energized cavity 100 to pass into pulse chamber 98 where it is absorbed by the gas therein. As the microwave cavities are energized in sequence, the microwave energy is caused to circulate around the pulse chamber 98. By properly adjusting the switching speed of multiplexer 118, the microwave energy is circulated around the pulse chamber 98 at the speed of sound in the gas. This causes a high pressure traveling pulse to be developed in the pulse chamber 98 in exactly the same manner and according to the same principles as described in the embodiment of FIG. 1. This traveling pulse creates a suction and discharge pressure cycle in exactly the same manner and according to the same principles as described in the embodiment of FIG. 1.

For ease of illustration, the number of microwave cavities 100 in FIG. 5 is limited. However, more microwave cavities 100 could be added, with the advantage of providing better localization and smoother movement of microwave power around the pulse chamber 98. The more cavities added, the closer the embodiment of FIG. 5 approaches the ideal of focusing the microwave energy on the pulse at all times.

As in the embodiment of FIG. 1, the velocity of the pulse in pulse chamber 98 will vary if the pressure and temperature of the gas in pulse chamber 98 varies. For optimal performance, the switching rate of multiplexer 118 should be variable, to allow adjustment of the velocity at which the microwave energy moves through pulse chamber 98. By varying the switching rate of multiplexer 118, the velocity of the absorption region within pulse chamber 98, can be made to match the speed of sound in the gas. An electronic control circuit can be provided which could vary the switching rate of multiplexer 118 in response to pressure information. For example, a phase-locked-loop or a microprocessor control circuit could read pressure information from a transducer in pulse chamber 98, and make appropriate adjustments in the switching rate of multiplexer 118. Many other control circuits could be easily designed by one skilled in the art of electronic controls.

Figure 6:
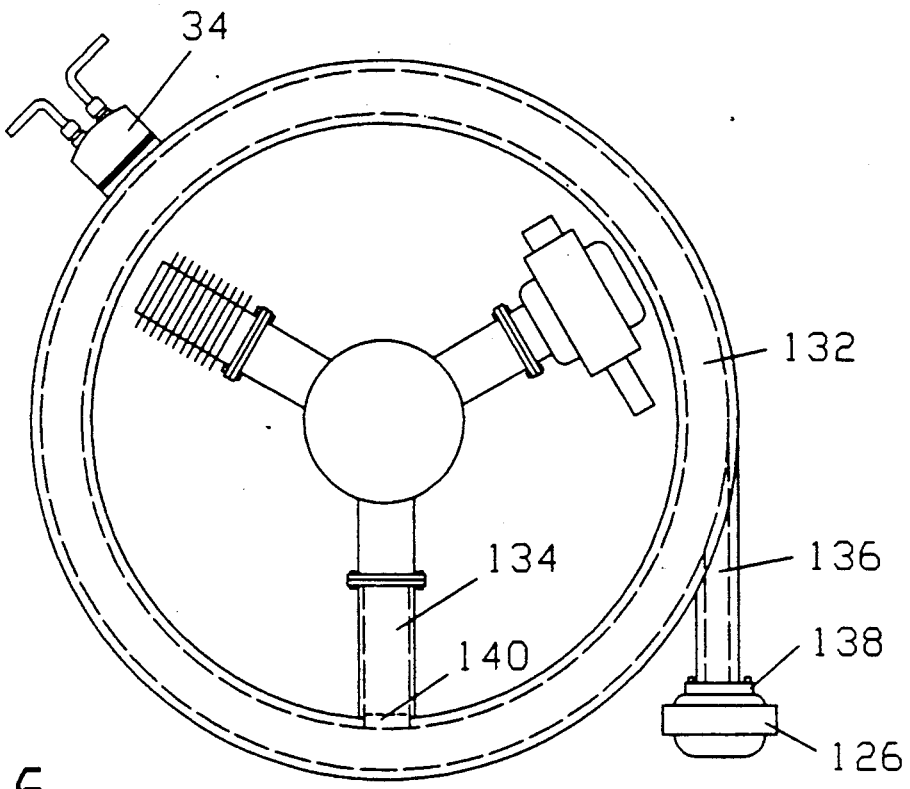
FIG. 6 is a sixth embodiment of the invention, which uses an acoustical driver to inject a pulse into a microwave filled pulse chamber, thereby causing only the pulse to absorb electromagnetic energy.

FIG. 6 shows a sixth embodiment which exploits pulse amplification. Toroidal pulse chamber 132 is provided, that consists of a microwave waveguide which is filled with a microwave absorbing gas. Acoustic driver 126 is connected to the end flange 138 of pulse injection tube 136 by common flange bolts. Acoustic driver 126 is an acoustic transducer capable of producing a high pressure pulse, such as a concert audio horn driver, or a piezoelectric driver. The familiar magnetron-terminator-circulator assembly shown, is connected to microwave cavity 134 by common flange bolts. Microwave window 140 allows microwave energy to pass, and provides a pressure seal between microwave cavity 134 and pulse chamber 132.

In operation, the familiar magnetron-terminator-circulator assembly provides microwave power to microwave cavity 134. This microwave energy enters pulse chamber 132 through microwave window 140. The frequency of this microwave energy is lower than the normal absorption frequencies of the gas in pulse chamber 132. Hence, the microwave energy is not immediately absorbed by the gas, and a microwave field is established throughout pulse chamber 132. Acoustic driver 126 launches a pulse into pulse injection tube 136 which then travels around the pulse chamber 132. If the pressure of this pulse is large enough, the gas within the pulse will begin to absorb the microwave energy which exists in pulse chamber 132. This selective absorption is due to the downward shift of absorption frequencies within the pulse, in response to the higher pressures within the pulse. As explained above, a gas at a given pressure which absorbs microwave energy at certain frequencies, will absorb at lower frequencies as its pressure is increased. In other words, as the pressure of a gas is increased, the frequencies at which the gas will absorb microwave energy shift to lower values. Therefore, the gas within the pulse will absorb much more microwave energy than the gas outside the pulse.

The ideal for any embodiment which utilizes pulse amplification, is that the E&M energy be focused on the pulse and only on the pulse. The present embodiment approaches this ideal, since the pulse will absorb significantly more microwave energy than any of the surrounding gas. Because of the pulse's microwave absorption and because it is naturally traveling at the speed of sound in the gas, it will be amplified in exactly the same manner and according to the same principles as described in the embodiment of FIG. 1. This means that all of the effects of acoustic trapping, nonlinearity, and increased microwave absorption will act to amplify the pressure of the pulse traveling in the pulse chamber 132. In addition, as the pulse is amplified, its pressure increase will further down shift its absorption frequencies, causing even more microwave power to be absorbed. In this way, the pressure of the pulse, which is launched by acoustic driver 126, is amplified as it travels around pulse chamber 132.

When the pulse passes over the suction and discharge tubes of reed valve assembly 34, suction and discharge of the gas take place in the same manner and according to same principles as in the embodiment of FIG. 1. Just before this traveling pulse arrives back at the intersection of pulse injection tube 136 and pulse chamber 132, acoustic driver 126 launches another pulse. This new pulse merges with the pulse in pulse chamber 132, thereby adding more energy to the pulse. The pulse will continue to absorb microwave energy all during its trip around pulse chamber 132. In this way the pulse can be reinforced by acoustic driver 126 as it travels around pulse chamber 132.

Under low demand operating conditions, it may not be necessary for acoustic driver 126 to launch a pulse each time the pulse in pulse chamber 132 passes by pulse injection tube 136. Instead, it may only be necessary to launch a new pulse after the pulse in pulse chamber 132 has orbited many times. Also, the amplitude of the pulse launched by acoustic driver 126 could be varied in response to changing load demands.

More than one pulse could be made to travel in pulse chamber 132, by firing acoustic driver 126 more than once during the time of a single pulse orbit. For example, if acoustic driver 126 is fired three times during the course of a single orbit, then three separate pulses will be caused to travel in the pulse chamber 132 at the same time. Since these pulse travel at the same speed, the effect is like that of a traveling wave in the pulse chamber 132. The more pulses fired during a single orbit, the shorter the wavelength and the higher the frequency of this traveling wave.

Figure 7:
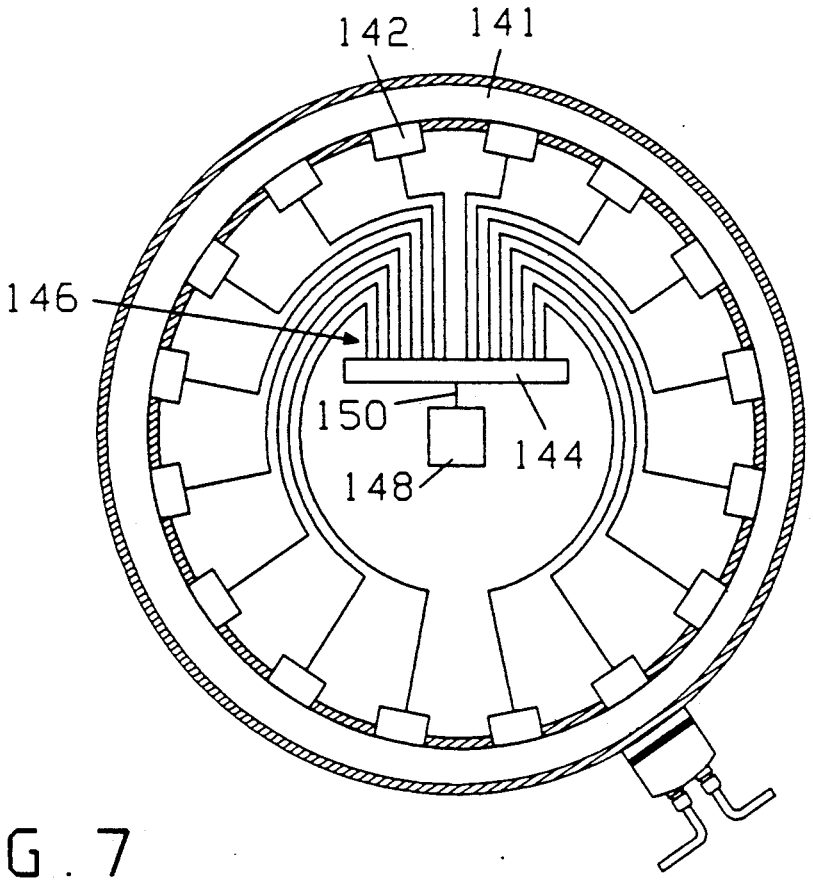
FIG. 7 is a partly sectional partly schematic view of a seventh embodiment of the invention, which uses a coaxial multiplexer as a means of alternately energizing a set of ultrasonic transducers, thereby sweeping ultrasonic energy through a gas.

An advantage of the embodiment of FIG. 7, is that the microwave energy does not need to be mechanically or electronically swept through the gas. This eliminates some of the moving parts and electronic components associated with sweeping the microwave energy, and simplifies the controls needed to assure that the microwave energy is always focused on the pulse. Microwave energy which is outside the pulse experiences little absorption and will be stored as resonant energy in pulse chamber 132. Microwave energy which is inside the pulse will be absorbed in the region of highest density and pressure, which is exactly where absorption is most desireable and results in the greatest pulse amplification. This selective absorption makes very efficient usage of the microwave energy.

It should be possible to use a high frequency ultrasonic transducer to serve as acoustic driver 126. In this case, acoustic driver 126 would emit a short train of pulses rather than a single pulse. Since high frequency acoustic energy can experience large absorptions in gases, this short pulse train could locally pressurize the gas in pulse injection tube 136. In this way a single pulse could be created which would travel out of pulse injection tube 136 and into pulse chamber 132. Ultrasonic drivers have the advantage of high power acoustic output and high efficiencies, compared to audio acoustic drivers.

For optimal performance, an electronic triggering circuit can be provided to assure that acoustic driver 126 will fire in phase with the traveling pulse, or pulses, in pulse chamber 132. A pressure sensor in pulse chamber 132 would sense when the pulse is about to pass by, and in response cause acoustic driver 126 to launch a new pulse which will be in phase with the passing pulse. Many other control circuits could be easily designed by one skilled in the art of electronic controls.

FIG. 7 shows a partly schematic partly sectional view of a seventh embodiment which exploits pulse amplification. In FIG. 7 a pulse chamber 141 is provided which has identical ultrasonic transducers 142 attached thereto, such that the ultrasonic transducers 142 are in contact with the gas in pulse chamber 141. Ultrasonic transducers 142 are located at equidistant points along the circumference of pulse chamber 141. Ultrasonic transducers 142 are all connected to multiplexer 144 by coaxial cables 146. The output of an ultrasonic generator 148 is connected to multiplexer 144 by coaxial cable 150.

In operation, ultrasonic generator 148 generates a radio-frequency E&M signal which passes through coaxial cable 150 and into multiplexer 144. Multiplexer 144 sequentially connects the coaxial cable 150 to the individual cables 146. In this way, E&M energy is applied in sequence to the individual ultrasonic transducers 142. Thus, ultrasonic transducers 142 are energized in sequence, one at a time. Ultrasonic acoustical energy which is produced by the individual ultrasonic transducers 142 passes into pulse chamber 141 where it is absorbed by the gas therein. The absorption of high frequency acoustic energy in gases, occurs in a manner analogous to the absorption of electromagnetic energy in gases. This acoustic absorption is due to three mechanisms: viscosity, thermal conduction, and thermal relaxation. In short, these three mechanisms serve to remove energy from the wave and convert it into random thermal motion and increased internal energy of the gas, which will be seen as a localized increase in the pressure of the gas.

As the ultrasonic transducers 142 are energized in sequence, the ultrasonic energy is caused to circulate around the pulse chamber 141. By properly adjusting the switching speed of multiplexer 144, the ultrasonic energy is circulated around the pulse chamber 141 at the speed of sound in the gas. This causes a high pressure traveling pulse to be developed in the pulse chamber 141, due to the nonlinearities and acoustic trapping of the pulse. The resulting high pressure of the pulse will result in greater absorption of ultrasonic energy, and so pulse amplification occurs. This traveling pulse creates a suction and discharge pressure cycle in exactly the same manner and according to the same principles as described in the embodiment of FIG. 1.

For ease of illustration, the number of ultrasonic transducers 142 in FIG. 7 is limited. However, more ultrasonic transducers 142 could be added, with the advantage of providing better localization and smoother movement of ultrasonic energy around the pulse chamber 141. The more cavities added, the closer the embodiment of FIG. 7 approaches the ideal of focusing the ultrasonic energy on the pulse at all times.

As in the embodiment of FIG. 1, the velocity of the pulse in pulse chamber 141 will vary if the pressure and temperature of the gas in pulse chamber 141 varies. For optimal performance, the switching rate of multiplexer 144 should be variable, to allow adjustment of the velocity at which the ultrasonic energy moves through pulse chamber 141. By varying the switching rate of multiplexer 144, the velocity of the ultrasonic absorption region within pulse tube 98, can be made to match the speed of sound in the gas. An electronic control circuit can be provided which could vary the switching rate of multiplexer 144 in response to pressure information. For example, a phase-locked-loop or a microprocessor control circuit could read pressure information from a transducer in pulse chamber 141, and make appropriate adjustments in the switching rate of multiplexer 144. Many other control circuits could be easily designed by one skilled in the art of electronic controls.

Doubtless, there are many other ways to cause a region of ultrasonic energy to travel through a gas at the speed of sound in the gas, and many such variations will occur to one skilled in the art.

Figure 8:
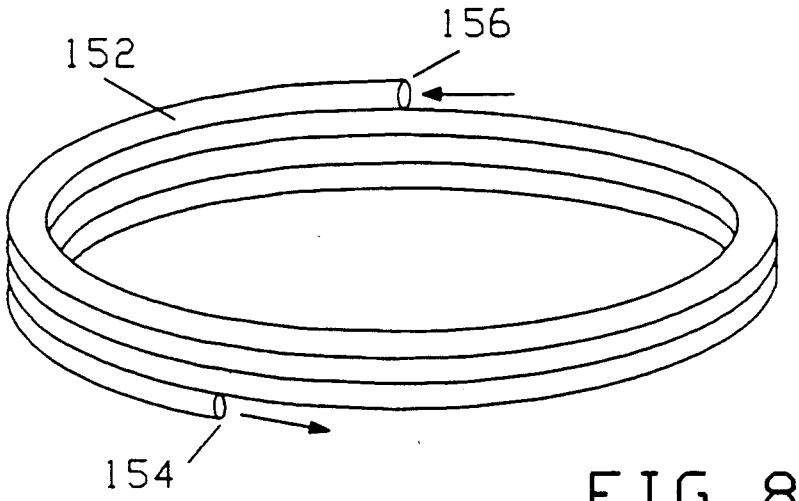
FIG. 8 is a perspective view of a spiral pulse chamber arrangement.

FIG. 8 shows a coiled pulse chamber arrangement which could be adapted to several of the embodiments of the present invention. In FIG. 8 a pulse chamber 152 is provided which comprises a long tube of microwave transparent material being wound into a coil. The ends of the coiled pulse chamber are not connected, but instead serve as a suction tube 156 and a discharge tube 154.

In operation, pulse chamber 152 can be placed, for example, in pulse chamber 10 of FIG. 1. In this case, suction tube 156 and discharge tube 154 would be allowed to pass through the outer wall 11 of pulse chamber 10 in FIG. 1. When microwave resonant chamber 18 of FIG. 1 spins, pulses would be formed at the suction end of pulse chamber 152, and would then continue to travel around the coiled pulse chamber until they exited at the discharge end of pulse chamber 152. As microwave resonant chamber 18 spins, each turn of pulse chamber 152's coil will be radiated with microwave energy. Thus, the single orifice 19 of microwave resonant chamber 18, will cause many individual pulses to exist in pulse chamber 152 at any given time. Since these pulses are formed at the suction tube 156 and exit at discharge tube 154, this arrangement could operate without a suction valve. A discharge valve on discharge tube 154 would be necessary to provide optimal performance, but pulse chamber 152 may be able to operate with no valves at all. The length of pulse chamber 152 would be determined by the pulse pressure required by a given application. The longer pulse chamber 152 is, the higher the pulse pressure will be, until a certain length is reached where a constant pressure pulse is achieved.

Figure 9:
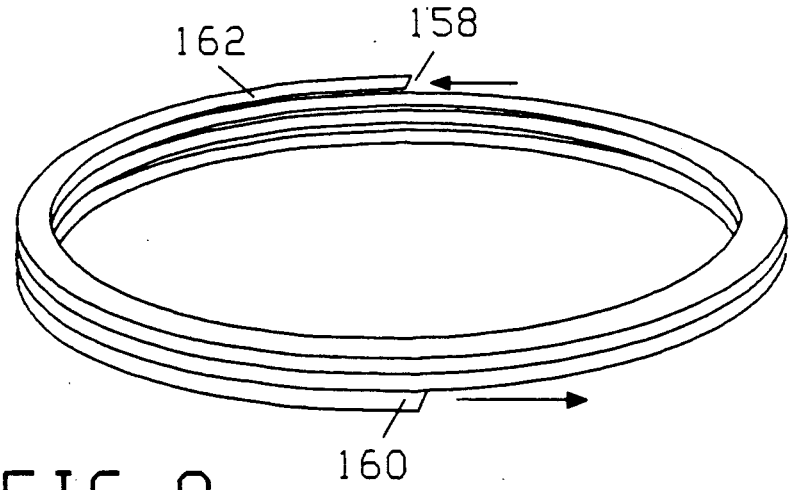
FIG. 9 is a perspective view of a spiral pulse chamber partition.

FIG. 9 illustrates another means by which to achieve a pulse chamber similar in effect to pulse chamber 152 of FIG. 8. FIG. 9 shows a flat metal spiraling partition 162, which could be installed in pulse chamber 10 of FIG. 1, thereby partitioning pulse chamber 10 of FIG. 1 into a spiraling cavity, having a suction end 158 and a discharge end 160. Appropriate suction and discharge openings would be provided in the outer wall 11 of pulse chamber 10 in FIG. 1.

RAMIFICATIONS

Gas Compression by Pulse Amplification provides an efficient means for the compression of gases which absorb E&M and ultrasonic energy. In particular, the present invention lends itself well to refrigeration applications, since many common refrigerants are good absorbers of microwave and infrared energy. Included in this group of refrigerants which absorb microwave and infrared energy, are several of the Freons and also ammonia.

At the present time, a new refrigerant, named R-134*a*, is being tested and developed as a replacement for the ozone depleting refrigerant R-12. R-134*a* is a good absorber in the microwave and infrared regions, and as such could be used in refrigeration systems which employ the present invention. Likewise, the electromagnetically driven embodiments of the present invention, will work well with any future refrigerant that absorbs E&M energy. Any current or future refrigerants which do not absorb E&M energy, can still be used with the ultrasonic embodiment of the present invention.

Although the present invention is particularly well suited for refrigeration applications, its use is not limited thereto. Any gas which will absorb either ultrasonic or E&M energy, can be compressed and conveyed by the present invention. Thus, the present invention will find many applications wherever gases need to be compressed and conveyed.

While the embodiments presented herein all describe the compression of gases, the present invention is not limited to the compression of gases alone. The pulse amplification effects described above, will also be seen with liquids which absorb E&M energy. Hence, such liquids could be pumped by the present invention.

The present invention lends itself easily to solar applications. For the infrared driven embodiments of the present invention, solar energy could be used as the source of the infrared radiation. Also, the sweeping system which sweeps the infrared energy through the gas, could be powered by solar cells. In this way the entire unit could be powered by solar energy. This solar power version suggests certain space applications, where solar energy is plentiful.

CONCLUSION AND SCOPE OF THE INVENTION

In summary, it has been shown that by sweeping E&M energy at the speed of sound through an E&M absorbing gas, three effects will combine synergistically, to pressure-amplify the resulting pulse. These effects are:

1. The trapping of acoustic energy in the region of absorption, which causes the pulse's pressure to increase,
2. Nonlinear effects which cause the pulse to evolve into a high pressure, high density shock wave,
3. Increased E&M absorption of the pulse due to effects 1 and 2, which in turn increases effects one and two.

Figure 10:
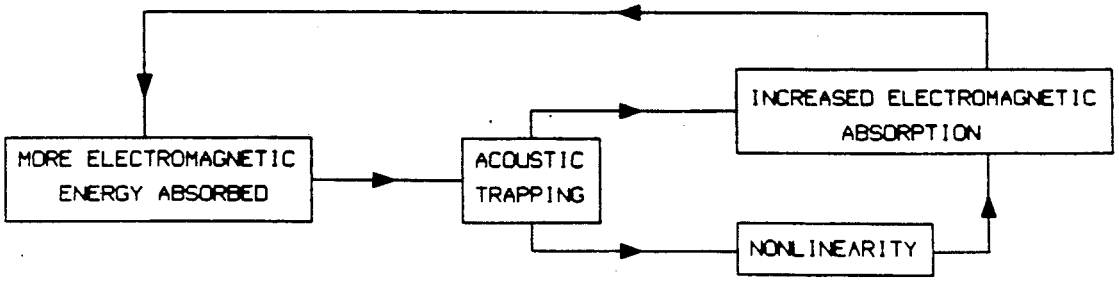
FIG. 10 is a flow diagram that depicts the principles of pulse amplification.

By so coupling these three effects, the pulse's pressure is increased through a form of positive feed back amplification. The nature of this coupling is illustrated by the diagram of FIG. 10. In this diagram, it is shown that acoustic trapping contributes directly to an increase in the E&M absorption of the pulse. In addition, acoustic trapping contributes to nonlinear effects, which serve to further increase the E&M absorption of the pulse. Because of the increased E&M absorption due to acoustic trapping and nonlinearities, a greater amount of E&M energy is absorbed by the pulse. This additional absorbtion of E&M energy takes the form of a pressure increase within the pulse. Due to acoustic trapping, part of this pressure gain is trapped within the pulse, and the sequence repeats. At some point a steady state will be reached where the pulse's pressure reaches an upper limit. In this way, these coupled effects induce a large pressure amplification of the pulse.

Of course, it is possible to pressurize a refrigerant in a chamber by exposing it to E&M energy from a stationary source. Since such a pressurization is due solely to the heating of the gas, it is necessary to double the temperature in order to double the pressure. This can be seen from the ideal gas equation. Pulse amplification is in sharp contrast to this type of heat pressurization. Pulse amplification can use a given amount of E&M energy to cause a much greater pressure gain, then were the same amount of E&M energy used for heat pressurization alone.

It is interesting to compare the energy gain resulting from the increase in gas pressure over and above heat pressurization, with the energy used to move a region of E&M energy through the gas. Using the embodiment of FIG. 1 as an example, the pressure gained by pulse amplification, over and above heat pressurization, can be achieved for only the small expense of energy required to spin microwave resonant chamber 18. Microwave resonant chamber 18 is nothing more than a flywheel which does no mechanical work. Once set in motion, the energy required to keep it spinning will be minimal. Therefore, much more energy is gained in the form of a pressure increase, then is used to spin resonant chamber 18. The difference between the additional energy gained above heat pressurization, minus the energy used to sweep the E&M energy through the gas, represents a free gain in pressure:

$$\left[\begin{array}{c}\text{ENERGY OF}\\ \text{PRESSURE GAIN}\end{array}\right]-\left[\begin{array}{c}\text{ENERGY USED FOR}\\ \text{E\&M SWEEPING}\end{array}\right]=$$

-continued $$\left[\begin{array}{c}\text{FREE}\\ \text{AMPLIFICATION}\end{array}\right]$$

So, by having chosen the proper sweep velocity, this intense pulse amplification is obtained in part for free. In other words, more energy is returned in the form of increased pressure than is spent to induce the amplifiying effect. This analysis can be applied to all of the embodiments of the present invention, including the ultrasonic embodiment, since these embodiments will expend little energy in causing a region of E&M or ultrasonic energy to travel through the gas.

Thus, it can be seen that the present invention harnesses the E&M and/or ultrasonic absorption of gases for the purpose of exciting a naturally occurring pressure amplification. Consequently, a gas pressurization is obtained which is much higher than the absorption of E&M or ultrasonic energy alone could produce. It can also be seen, that the present invention provides a highly reliable oil-less compressor suitable for refrigeration applications, which has no moving parts that come in contact with the refrigerant, other than valves. Finally, it can be seen that the present invention provides a gas compressor, which can be driven by different wavelengths of E&M and/or ultrasonic energy, as long as these wavelengths are readily absorbed by the gas.

While the above description contains many specificities, these should not be construed as limitations on the scope of the invention, but rather as an exemplification of one preferred embodiment thereof. Accordingly, it is the synergistic combination of the above mentioned physical principles, rather than a specific apparatus, which is the primary subject of the present invention.

Many other variations and improvements of such apparatus are possible, and may readily occur to those skilled in the art. For example, the rotating microwave resonant chamber 18 of FIG. 1 could be suspended by magnetic bearings, thereby decreasing the energy consumed due to friction. Also, the orifice 19 of chamber 18 in FIG. 1 need not be only a slit, but could assume many different configurations which could provide various radiation patterns. In addition, all of the embodiments shown in the above specification can be modified to support more than one pulse at a time.

Another variation would be to relocate the discharge and suction valves, shown in all of the embodiments. The suction and discharge valves need not be located at the same place in the pulse chamber. The discharge and suction valves could be separated to different locations in the pulse chamber. Also, more than one set of valves could be used. If several sets of suction and discharge valves were located around the perimeter of the pulse chamber, then a more continuous flow of gas into and out of the pulse chamber could be obtained. Furthermore, there are many types of valves which could be used with the present invention. Any valve which can open and close at a fast enough rate could be used. Different valve types that could be used include activated valves such as a solenoid or piezoelectrically operated valve, reed valves, typical compressor valves, check valves, and series connected orifice valves such as in U.S. Pat. Nos. 3,361,067 to Anderson, 3,657,930 to Jacobson, and 3,898,017 to Mandroian. Furthermore, the suction and discharge tubes 30 and 32 as shown in FIG. 1, could be oriented so as to be tangential to pulse chamber 10, or any angle, rather than only perpendicular to pulse chamber 10.

An additional variation could include different types of pulse chambers. For example, other possible pulse chamber arrangements could include straight rather than toroidal chambers, whereby pulses would travel back and forth, being reflected at each end of the straight pulse chamber. Many of the embodiments which provide toroidal pulse chambers could be converted to linear pulse chambers. Any chamber which will support a traveling pulse, and can be swept with E&M or ultrasonic energy, could be used as a pulse chamber.

A further variation would be to combine different characteristics of various embodiments into a single embodiment. For example, both low and high frequency absorption could be utilized in a single embodiment. High frequencies could be used to sweep through the gas thus forming a pulse. Low frequencies already present in the pulse chamber would be absorbed only by the pulse, due to the increase in low frequency absorption as pressure increases. Another such combination of embodiments would be to use the low frequency microwave absorption methods of FIG. 6 with the acoustic absorption methods of FIG. 7. In this way a high pressure pulse would be created by ultrasonic transducers, and the pulse would subsequently absorb low frequency microwave radiation in the pulse chamber.

A still further variation would be to use different types of E&M sources. Although many of the embodiments of the present invention show the use of magnetron tubes, other sources of E&M energy could be used as well.

Alternates could include solid state microwave sources such as IMPATT and GUNN effect diodes, and tubes such as KLYSTRONs, GYRATRONs, and Traveling Wave Tubes. Since solid state sources are compact, they could be mounted directly in chamber 18 of FIG. 1, or on a spinning disk arrangement such as disk 62 in FIG. 3. Another possible E&M source could include an infrared molecular LASER. Such LASERs have been constructed which use common refrigerants as the active LASER medium. Thus, the same refrigerant could be used both in the refrigeration system and as a active LASER medium. By so doing, a good match could be made between the emission spectra of the LASER and the absorption spectra of the refrigerant. Also, it may even be possible with the proper pulse chamber arrangement, to cause the refrigerant in the pulse chamber to laze within a limited region, and to cause this lazing region to travel through the gas at the speed of sound in the gas. This would create the traveling pressure disturbance necessary for pulse amplification to occur. In short, any E&M source that fits a particular design application can be used.

Additional variations could be added to the embodiment of FIG. 7 to provide various means of causing a localized region of ultrasonic energy to travel through the gas at the speed of sound in the gas. One such variation can be a rotating disk similar to the disk of FIG. 3. One or more ultrasonic transducers could be flush mounted to the outer surface of the disk, and the disk would be allowed to come in contact with the gas. Thus, the spinning disk would define one wall of a pulse chamber, and the ultrasonic energy would be swept through the gas in this pulse chamber at the speed of sound in the gas.

Finally, imposed electric and magnetic fields may make favorable changes in the E&M absorption properties of a gas. Such changes could include increasing the E&M absorption of a gas by applying electric or magnetic fields across the gas while absorption is taking place. Other changes would be to cause a shift in the absorption frequencies of a gas due to imposed fields. This later property could be exploited in an embodiment similar to that of FIG. 6, wherein the acoustic driver 126 would be eliminated. A pulse chamber such as pulse chamber 132, would be filled with microwave energy whose frequency would be different from the absorption frequencies of the undisturbed gas. By sweeping a static magnetic or electric field around the pulse tube, the absorption frequencies of the gas within the static field region would shift, and this gas would begin to absorb microwave energy from the microwave field, thereby forming a traveling pulse.

These and other variations and improvements of apparatus employing Gas Compression by Pulse Amplification are certainly possible. Accordingly, the scope of the invention should be determined not by the embodiments illustrated, but by the appended claims and their legal equivalents.

What is claimed is:

1. A compressor comprising:

a chamber having an inlet and an outlet for receiving a medium to be compressed;

an electromagnetic energy source for generating electromagnetic energy in said chamber, said electromagnetic energy having at least one localized region; and sweeping means for causing said at least one localized region of said electromagnetic energy to travel through the medium in said chamber at substantially the speed of sound so that at least one high pressure travelling pulse is created in said chamber, said at least one high pressure travelling pulse causing the medium to be alternately compressed and rarefied.

2. A compressor comprising:

(a) a chamber for receiving a medium to be compressed;

(b) a ingress means which allows said medium to enter said chamber;

(c) means to restrict egress through said ingress means;

(d) a egress means which allows said medium to exit said chamber;

(e) means to restrict ingress through said egress means;

(f) a ultrasonic energy source which generates ultrasonic energy;

(g) a sweeping means which causes one or more localized regions of said ultrasonic energy from said ultrasonic energy source, to travel through said medium in said chamber at approximately the speed of sound in said medium in said chamber, whereby one or more high pressure traveling pulses are created in said chamber, said one or more high pressure traveling pulses causing said medium to be alternately compressed and rarefied so that said medium is drawn in through said ingress means into said chamber, compressed therein, and then discharged through said egress means.

3. The compressor of claim 2 further including:

(a) said chamber comprising a toroidally shaped chamber;

(b) said ultrasonic energy source comprising a plurality of ultrasonic transducers being placed in contact with said medium in said toroidally shaped chamber at equidistant points along the perimeter of said toroidally shaped chamber, and a ultrasonic generator which generates electromagnetic energy, said electromagnetic energy being used to energize said plurality of ultrasonic transducers;

(c) said sweeping means comprising said plurality of ultrasonic transducers, a multiplexer, an electromagnetic energy conveying means which conveys said electromagnetic energy from said ultrasonic generator to said multiplexer, a plurality of electromagnetic energy conveying means which conveys said electromagnetic energy from said multiplexer to each of the single said individual ultrasonic transducers, whereby said multiplexer sequentially switches said electromagnetic energy from said ultrasonic generator to each said individual ultrasonic transducer, which causes said ultrasonic transducers to be energized in sequence.

4. A compressor comprising:

(a) a chamber for receiving a medium to be compressed;

(b) a ingress means which allows said medium to enter said chamber, (c) means to restrict egress through said ingress means;

(d) a egress means which allows said medium to exit said chamber;

(e) means to restrict ingress through said egress means;

(f) a electromagnetic energy source which generates electromagnetic energy;

(g) a sweeping means which causes one or more localized regions of said electromagnetic energy from said electromagnetic energy source, to travel through said medium in said chamber at approximately the speed of sound in said medium, whereby one or more high pressure traveling pulses are created in said chamber, said one or more high pressure traveling pulses causing said medium to be alternately compressed and rarefied so that said medium is drawn in through said ingress means into said chamber, compressed therein, and then discharged through said egress means.

5. The compressor of claim 4 further including:

(a) said chamber comprising a toroidally shaped chamber;

(b) said electromagnetic energy source comprising a microwave source which generates microwave energy;

(c) said localized regions of said electromagnetic energy comprising a localized region of said microwave energy;

(d) said sweeping means comprising a spinning microwave resonant chamber, said spinning microwave resonant chamber supporting a resonant mode of said microwave energy from said microwave source and having one or more orifices which allow said microwave energy to radiate out of said spinning microwave resonant chamber through said one or more orifices and into said toroidally shaped chamber.

6. The compressor of claim 4 further including:

(a) said chamber comprising a toroidally shaped chamber;

(b) said sweeping means comprising a spinning electromagnetic reflector which reflects said electromagnetic energy from said electromagnetic energy source into said toroidally shaped chamber.

7. The compressor of claim 4 further including:

(a) said chamber comprising a toroidally shaped chamber;

(b) said electromagnetic energy source comprising one or more infrared energy sources which generate infrared energy;

(c) said localized region of said electromagnetic energy comprising a localized region of said infrared energy;

(d) said sweeping means comprising a spinning disk, having said one or more infrared energy sources affixed to the perimeter of said disk, such that said infrared energy from said one or more infrared energy sources passes into said toroidally shaped chamber.

8. The compressor of claim 4 further including:

(a) said chamber comprising a toroidally shaped chamber;

(b) said electromagnetic energy source comprising a microwave source of variable frequency which generates microwave energy;

(c) said localized region of said electromagnetic energy comprising a localized region of said microwave energy;

(d) said sweeping means comprising said microwave source of variable frequency, a plurality of microwave cavities which are placed at equidistant points along the perimeter of said toroidally shaped chamber such that any of said microwave energy in said microwave cavities will pass from said microwave cavities into said toroidally shaped chamber, a plurality of individually tuned bandpass filters, a plurality of microwave conveying means which conveys said microwave energy from said microwave source of variable frequency to said individually tuned bandpass filters, a second plurality of microwave conveying means which conveys said microwave energy from the single said individually tuned bandpass filters to the single said microwave cavities;

whereby said microwave source of variable frequency sweeps over a frequency range, which causes said microwave cavities to be energized in sequence.

9. The compressor of claim 4 further including:

(a) said chamber comprising a toroidally shaped chamber;

(b) said electromagnetic energy source comprising a microwave source;

(c) said localized region of said electromagnetic energy comprising a localized region of said microwave energy;

(d) said sweeping means comprising said microwave source, a plurality of microwave cavities which are placed at equidistant points along the perimeter of said toroidally shaped chamber such that any of said microwave energy in said microwave cavities will pass from said microwave cavities into said toroidally shaped chamber, a microwave multiplexer, a microwave conveying means which conveys said microwave energy from said microwave source to said multiplexer, a plurality of microwave conveying means which conveys said microwave energy from said multiplexer to each of the single said individual microwave cavities, whereby said microwave multiplexer switches said microwave energy from said microwave source to each said individual microwave cavity, which causes said microwave cavities to be energized in sequence.

10. The compressor of claim 4 further including:

(a) said chamber comprising a toroidally shaped chamber;

(b) said electromagnetic energy source comprising a microwave source;

(c) said localized region of said electromagnetic energy comprising a localized region of said microwave energy;

(d) said sweeping means comprising a microwave conveying means which conveys said microwave energy from said microwave source into said toroidally shaped chamber, said microwave source having a frequency which is lower than most of the absorption frequencies of the undisturbed gas in said toroidally shaped chamber, thus causing said microwave energy from said microwave source to exist throughout said toroidally shaped chamber being largely unabsorbed by the undisturbed gas, an acoustic driving means which is attached to said toroidally shaped chamber by a pulse injection conduit, said pulse injection conduit coupling acoustic energy from said acoustic driving means into said toroidally shaped chamber, whereby said acoustic driving means launches a pulse which travels through said pulse injection conduit and into said toroidally shaped chamber, the relatively high pressure within said pulse causing said pulse to absorb said microwave energy which exists throughout said toroidally shaped chamber.

11. The compressor of claim 4 further including:

(a) said chamber comprising a coiled tubular chamber having a suction end and a discharge end, said suction end and said discharge end being unconnected to each other;

(b) said compressor being operable with or without said ingress means, whereby said one or more high pressure traveling pulses are created at said suction end of said coiled tubular chamber, and said one or more high pressure traveling pulses exit said coiled tubular chamber at said discharge end of said coiled tubular chamber.

12. The compressor of claim 4 further including:

(a) said chamber comprising a toroidally shaped chamber, said toroidally shaped chamber being partitioned by a flat spiraling partition, said flat spiraling partition having a suction end and a discharge end, said suction end and said discharge end being unconnected to each other;

(b) said compressor being operable with or without said ingress means, whereby said one or more high pressure traveling pulses are created at said suction end of said flat spiraling partition, and said one or more high pressure traveling pulses exit said flat spiraling partition at said discharge end of said flat spiraling partition.

* * * * *